US005777539A

United States Patent [19]

Folker et al.

[11] Patent Number: 5,777,539

[45] Date of Patent: Jul. 7, 1998

[54] INDUCTOR USING MULTILAYERED PRINTED CIRCUIT BOARD FOR WINDINGS

[75] Inventors: Donald Victor Folker, Fort Wayne, Ind.; Randhir Singh Malik, Colchester, Vt.; Robert Sterling Rowland, Raleigh, N.C.

[73] Assignee: International Business Machines Corporation, Armonk, N.Y.

[21] Appl. No.: 535,302

[22] Filed: Sep. 27, 1995

[51] Int. Cl.[6] ..... H01F 5/00; H01F 27/28

[52] U.S. Cl. ..... 336/200; 336/223; 336/232

[58] Field of Search ..... 336/200, 205, 336/232, 223; 428/210

[56] References Cited

U.S. PATENT DOCUMENTS

| | | | |
|---|---|---|---|
| 5,179,365 | 1/1993 | Raggi | 336/83 |
| 5,312,674 | 5/1994 | Heartling et al. | 428/210 |
| 5,386,206 | 1/1995 | Iwatani et al. | 336/200 |
| 5,402,098 | 3/1995 | Ohta et al. | 336/232 |
| 5,461,353 | 10/1995 | Eberhardt | 336/200 |
| 5,521,573 | 5/1996 | Inoh et al. | 336/200 |

FOREIGN PATENT DOCUMENTS

| | | | |
|---|---|---|---|
| 61-42109 | 2/1986 | Japan | 336/205 |

*Primary Examiner*—Vit W. Miska
*Assistant Examiner*—Anh Mai
*Attorney, Agent, or Firm*—Arthur J. Samodovitz

[57] ABSTRACT

An inductor or transformer uses a multilayer printed circuit board to form the conductor turns. Each layer comprises a dielectric sheet and a conductor printed on the sheet. Each of the conductors has approximately the same shape as each other (such as circular or rectangular), is superimposed on the other conductors and is substantially closed on itself (with a gap to separate the two ends). A multiplicity of through-hole vias are evenly spaced around the conductors and pass through the multiplicity of layers. Successive vias make an electrical connection between successive pairs of adjacent conductors such that current passes in the same direction through all of the conductors. Each layer provides (N−1)/N turns such that N layers provide N−1 complete turns. A ferrite core material passes through a hole in the printed circuit board within the conductors.

31 Claims, 11 Drawing Sheets

| LAYERS | HOLES | | | | | | | | | | | | |
|---|---|---|---|---|---|---|---|---|---|---|---|---|---|
| | 62 | 3435a | 3435b | 3435c | 3435d | 3435e | 3435f | 3435g | 3435h | 3435i | 3435j | 3435k | 72 |
| 28a | X | X | 0 | 0 | 0 | 0 | 0 | 0 | 0 | 0 | 0 | 0 | 0 |
| 28b | 0 | X | X | 0 | 0 | 0 | 0 | 0 | 0 | 0 | 0 | 0 | 0 |
| 28c | 0 | 0 | X | X | 0 | 0 | 0 | 0 | 0 | 0 | 0 | 0 | 0 |
| 28d | 0 | 0 | 0 | X | X | 0 | 0 | 0 | 0 | 0 | 0 | 0 | 0 |
| 28e | 0 | 0 | 0 | 0 | X | X | 0 | 0 | 0 | 0 | 0 | 0 | 0 |
| 28f | 0 | 0 | 0 | 0 | 0 | X | X | 0 | 0 | 0 | 0 | 0 | 0 |
| 28g | 0 | 0 | 0 | 0 | 0 | 0 | X | X | 0 | 0 | 0 | 0 | 0 |
| 28h | 0 | 0 | 0 | 0 | 0 | 0 | 0 | X | X | 0 | 0 | 0 | 0 |
| 28i | 0 | 0 | 0 | 0 | 0 | 0 | 0 | 0 | X | X | 0 | 0 | 0 |
| 28j | 0 | 0 | 0 | 0 | 0 | 0 | 0 | 0 | 0 | X | X | 0 | 0 |
| 28k | 0 | 0 | 0 | 0 | 0 | 0 | 0 | 0 | 0 | 0 | X | X | 0 |
| 28l | 0 | 0 | 0 | 0 | 0 | 0 | 0 | 0 | 0 | 0 | 0 | X | X |

FIG. 14

INDUCTOR USING MULTILAYERED PRINTED CIRCUIT BOARD FOR WINDINGS

BACKGROUND OF THE INVENTION

The invention relates generally to flat inductors formed from printed circuit board technology, and deals more particularly with improvements therein for high power applications.

Inductors have previously been formed from single or multi-layered printed circuit boards. The basic construction comprises a spiral conductor on each layer forming one or more "turns". A hole is drilled within the spiral, and a core material is supported therein. For example, the core includes an E-shaped section, and a middle leg of the E-shaped section is supported within the hole to form part of the core. The middle leg has a circular cross-section and each of the outer legs has a circular or rectangular cross-section. The two outer legs pass through "dummy" holes in the printed circuit board. The remaining section of the core is formed by a ferrite bar which is bonded to the ends of the legs of the E-shaped section. This yields two flux paths through the inductor turns.

The width of the spiral conductor depends on the current carrying requirement—the greater the current carrying requirement, the greater the width of the conductor. Typically, a predetermined area is reserved for the inductor and the one or more turns are printed on each layer according to well known printed circuit board technology. After each layer is so printed, the layers are bonded together by glass epoxy, and through-hole "vias" or blind "vias" are used to interconnect the turns of the different layers.

A through-hole via is formed by drilling a hole through the layers at a position to intersect ends of two of the spiral conductors and then "seeding" the inner surface of the holes with a water soluble adhesive. Next, copper is electrolessly plated on the adhesive to interconnect the conductors. Next, additional copper is electrically plated over the electroless copper plate to the desired thickness. Finally, the holes are filled with solder to protect the copper plate. A separate via is required for each pair of spiral conductors on adjacent layers to render all of the turns in series. Each such through-hole via is positioned not to intersect the other conductors.

A "blind" via is formed by drilling holes in selected layers before the layers are bonded together. Then, the layers are successively bonded together and, while exposed, the inner surface of the holes are seeded with nickel, electrolessly plated with copper and then filled with solder. The resultant vias extend between the two layers sought to be electrically connected. Thus, the hole does not pass through other layers, and no area is required on these other layers to clear the via. However, the blind via fabrication process is much more expensive than the through-hole fabrication process.

It was also known to use the foregoing technology to fabricate each winding of a transformer using two or more printed circuit board layers each having a spiral conductor configuration.

While the foregoing technology was effective to form inductors and transformers, the layout of the conductors and vias were customized for each layer and board and did not optimize area on the printed circuit board or width of the conductors. Therefore, improvements are desirable to increase the current capability, improve overall performance and simplify and standardize design.

SUMMARY OF THE INVENTION

The invention resides in an inductor or transformer using a multilayer printed circuit board to form the conductor turns. Each layer comprises a dielectric sheet and a conductor printed on the sheet. Each of the conductors has approximately the same shape as each other (such as circular or rectangular), is superimposed on the other conductors and is substantially closed on itself (with a gap to separate the two ends). A multiplicity of through-hole vias are spaced around the conductors and pass through the multiplicity of layers. Successive vias make an electrical connection between successive pairs of adjacent conductors such that current passes in the same direction through all of the conductors. Each layer provides (N−1)/N turns such that N layers provide N−1 complete turns. A ferrite core material passes through a hole in the printed circuit board within the conductors. Based on this design, the current capability and board usage is maximized and the design is simplified and standardized for inductors and transformers with different numbers of turns. Moreover, with this simple and standardized design the series resistance and parasitic capacitance are known.

DESCRIPTION OF THE FIGURES

FIG. 14 is a table indicating electrical connections made by through-hole vias within the printed circuit board of FIG. 1.

DETAILED DESCRIPTION OF THE PREFERRED EMBODIMENTS

Figure 1:
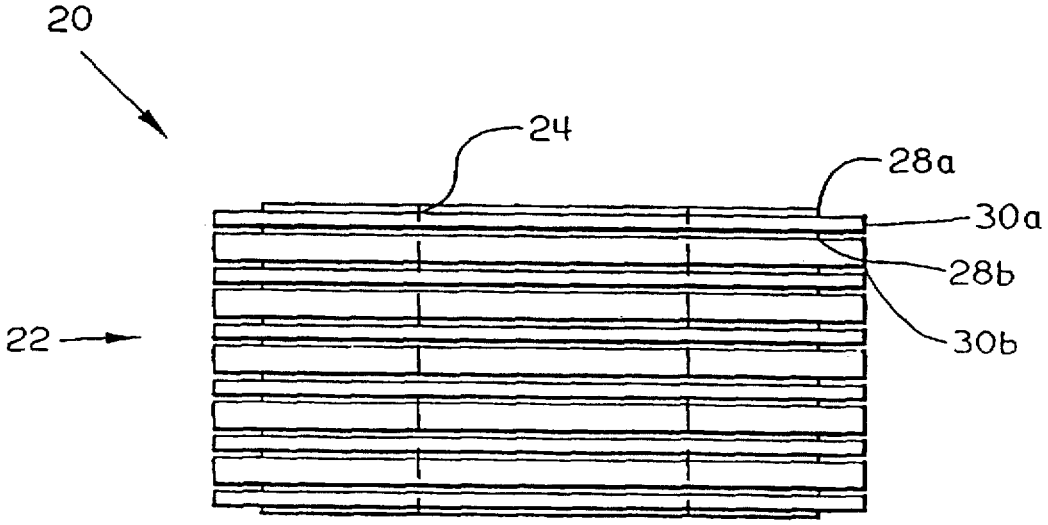
FIG. 1 is an enlarged side view of an inductor or part of a transformer comprising a multilayer printed circuit board according to the present invention.
Figure 3:
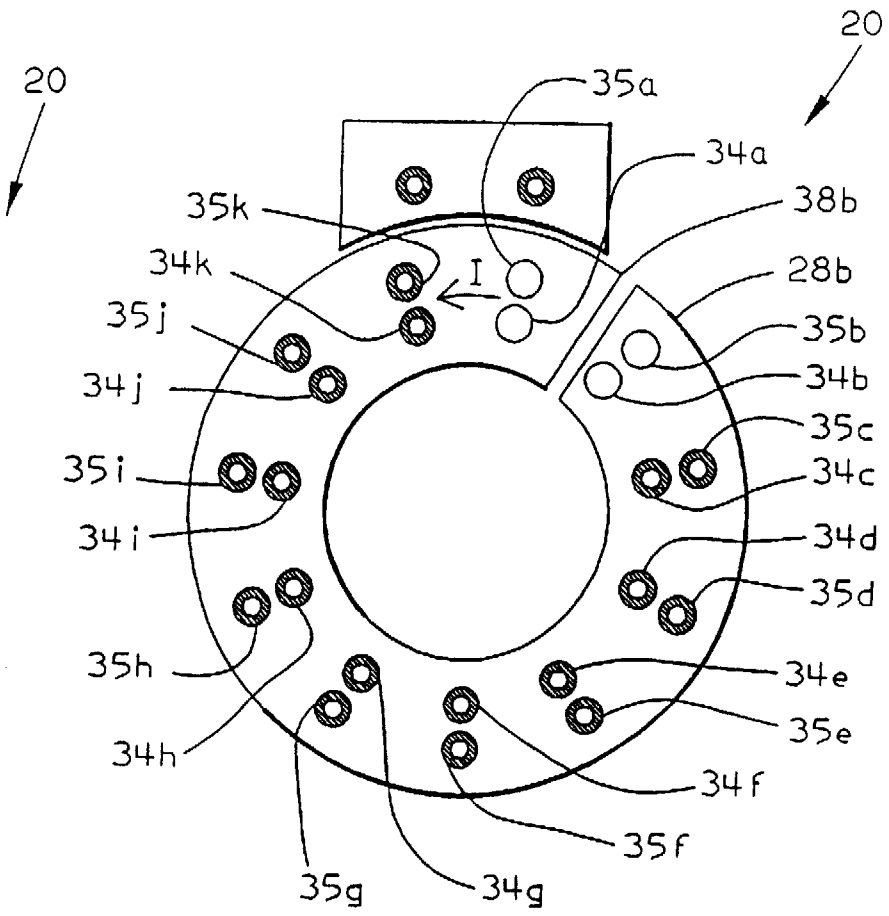
FIGS. 2–13 are top views of twelve respective layers of the printed circuit board of FIG. 1.

Referring now to the figures in detail wherein like reference numbers indicate like elements throughout, FIG. 1 illustrates an inductor generally designated 20 according to the present invention. Inductor 20 comprises a multilayered printed circuit board 22 (FIG. 1) and a ferrite core 24. Each layer includes a single conductor 28*a, b* . . . N printed on a dielectric sheet 30*a, b* . . . N. "N" equals the total number of layers containing conductors within the inductor. As further illustrated in FIGS. 2–13, all the conductors are washer-shaped and superimposed on one another to form a "stack" of N washer-shaped conductors (with dielectric between the layers). By way of example, each dielectric sheet is made of "FR4" fiberglass reinforced exposy resin, each of the two outermost dielectric sheets is 3 mils thick, each of the inner sheets is 5 mils thick and each washer-shaped conductor is made of copper and is 0.2 inches wide and 7 mils thick. However, the conductor dimensions depend on the current carrying requirement.

Figure 15:
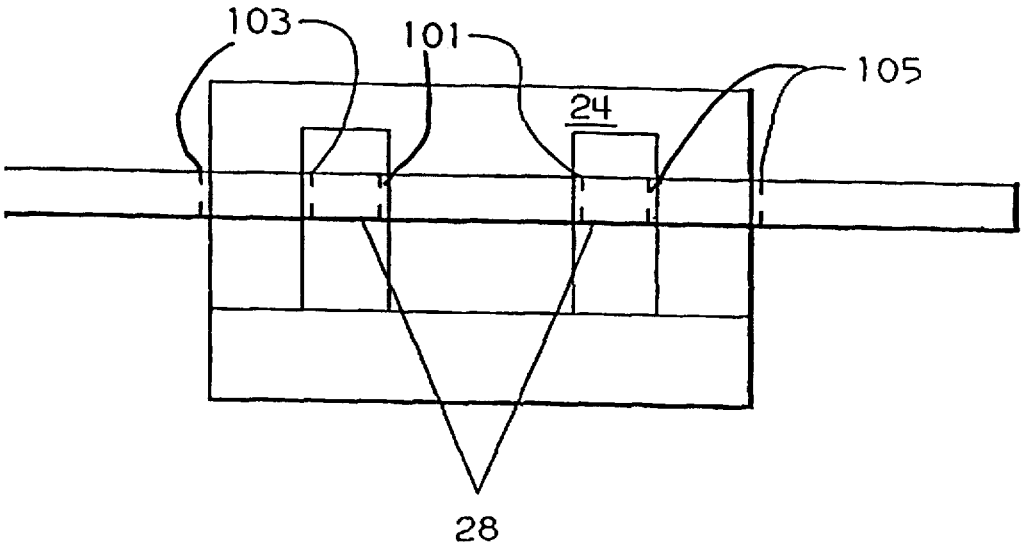
FIG. 15 illustrates a core within the inductor of FIG. 1.
Figure 16:
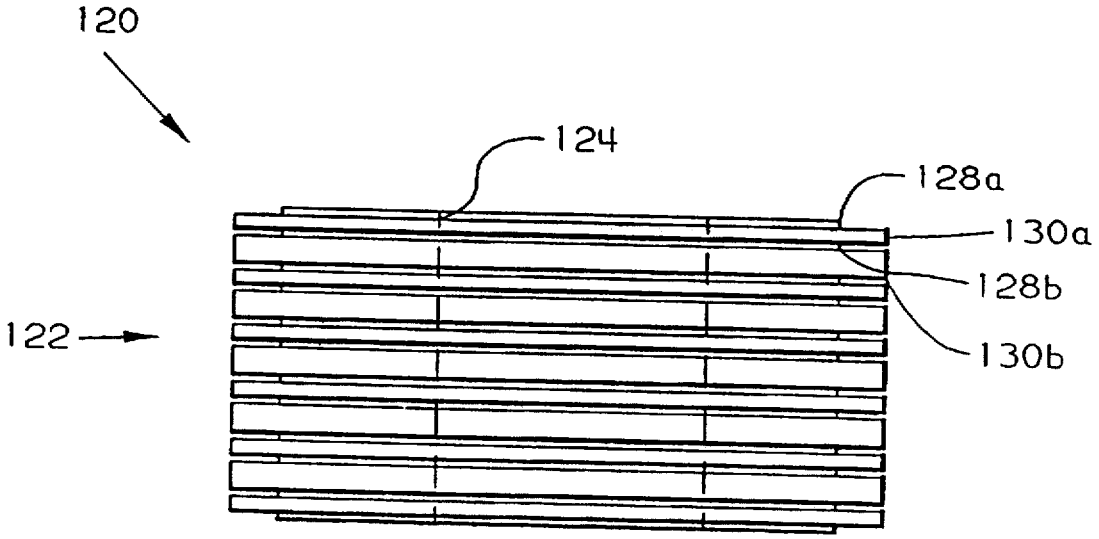
FIG. 16 is an enlarged side view of an inductor or part of a transformer comprising a multilayer printed circuit board according to the present invention.

As illustrated in FIG. 15, the core 24 comprises an E-shaped ferrite material and a bar-shaped ferrite material which is bonded to the ends of the E-shaped ferrite material. The middle leg of the E-shaped ferrite material passes through a hole 101 in the printed circuit board within the conductors 28*a–l* and the two outer legs pass through "dummy" holes 103 and 105. The middle leg has a circular cross-section and each of the outer legs has a circular (or possibly a rectangular) cross-section. This yields two flux paths through the core material.

There are (a minimum of) N−1 drill sites 34*a, b* . . . N−1 through the washer-shaped conductors 28*a, b* . . . N and associated dielectric sheets 30*a, b* . . . N for N layers to subsequently form a set of N−1 through-hole vias. In the illustrated embodiment, the drill sites 34*a, b* . . . N−1 are replicated as paired drill sites 35*a, b, c*, N−1 which are offset radially from and make the same connections as respective drill sites 34*a, b* . . . N to subsequently form an additional set of through-hole vias to accommodate greater current between conductors 28*a, b* . . . N than could be accommodated by a single set of N−1 vias. The drill sites 34*a, b* . . . N and 35*a, b* . . . N are preferably, but not necessarily, evenly spaced around the washer. As illustrated by FIGS. 2–13 and the table of FIG. 14, each resultant through-hole via intersects the washer-shaped conductors of two adjacent layers. The washer-shaped conductors of the other layers are etched back from this pair of drill holes (i.e. "clearance lands") to prevent an electrical connection from the through-hole vias resulting from this pair of drill holes.

There is also a radial gap (or break) 38*a, b* . . . N in each washer-shaped conductor, however, the gaps 38*a, b* . . . N of conductors 28*a, b* . . . N are not superimposed upon one another. The gap for each washer-shaped conductor is adjacent to and situated between the two pairs of vias which connect to this washer-shaped conductor (i.e. the one leading to and the one leading from this washer-shaped conductor). In the illustrated embodiment where the pair of drill sites for successive conductors 28*a, b* . . . N proceed clockwise, the gaps 38*a, b* . . . N for conductors 28*a, b, c*, N−1 also proceed clockwise. This results in a counterclockwise flow of electricity, i.e. counter clockwise around conductor 28*a*, down vias 34*a* and 35*a* to conductor 28*b*, counterclockwise around conductor 28*b*, down vias 34*b* and 35*b* to conductor 28*c*, counterclockwise around conductor 28*c*, etc.

Figure 2:
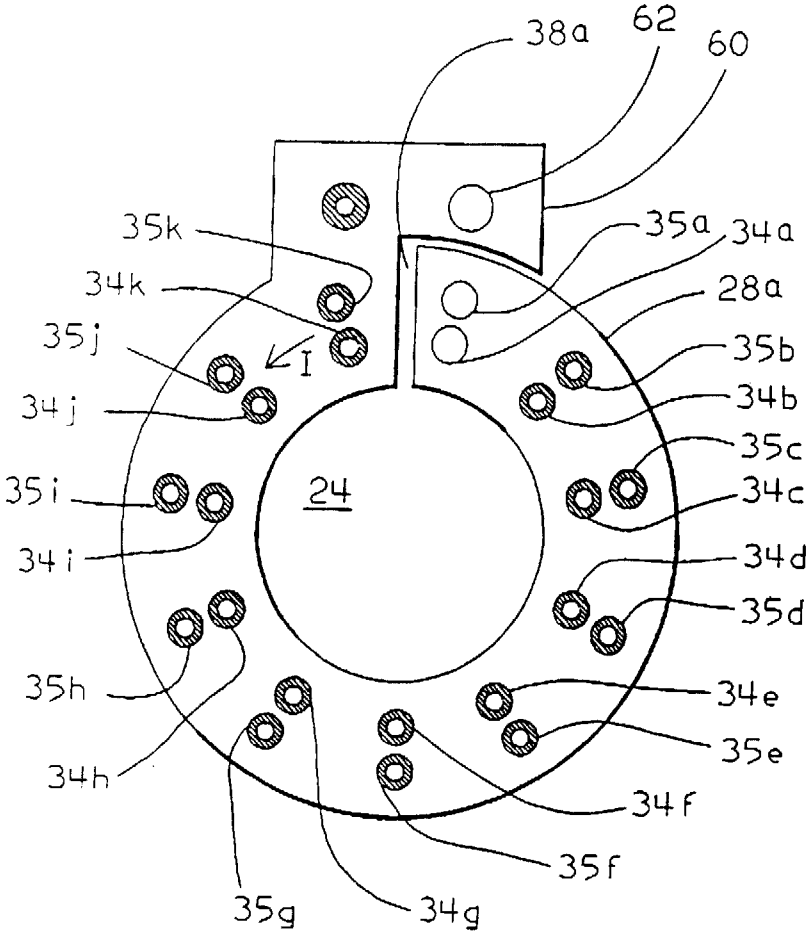
Figure 5:
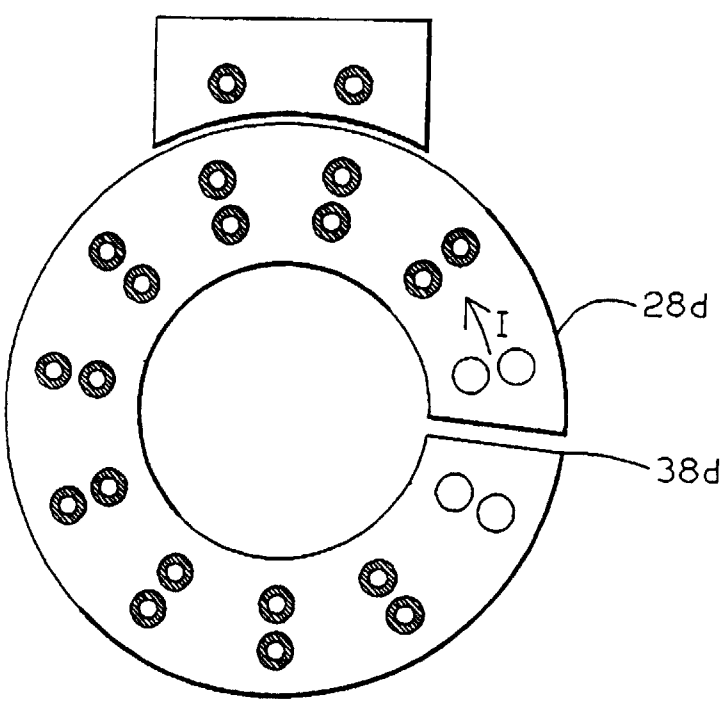
Figure 4:
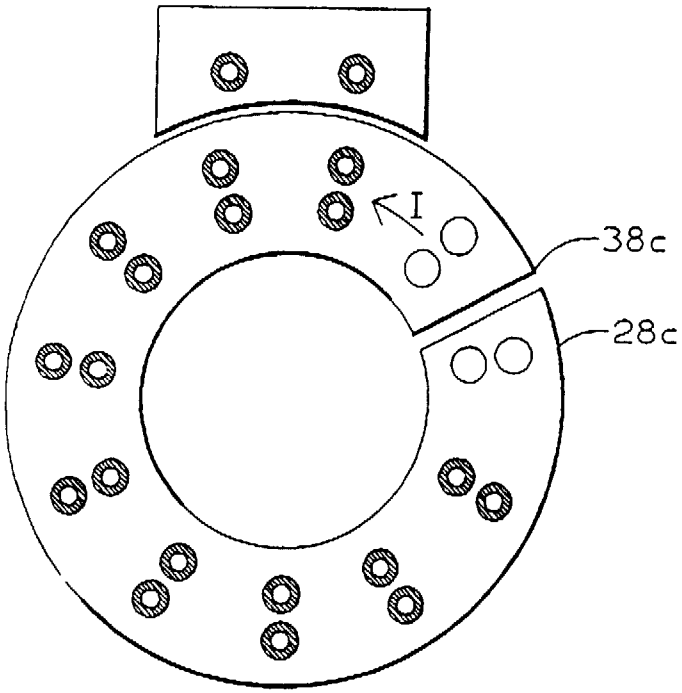
Figure 7:
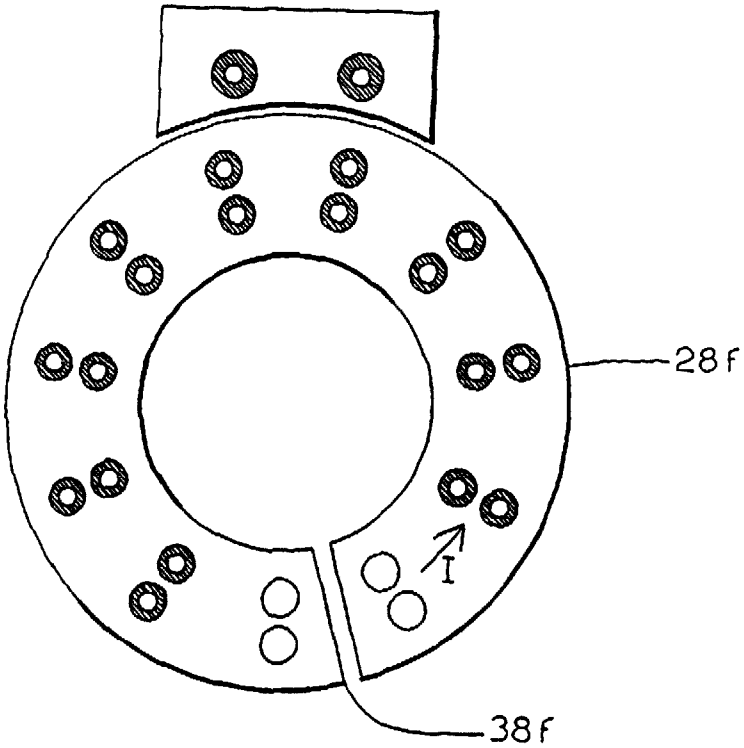
Figure 6:
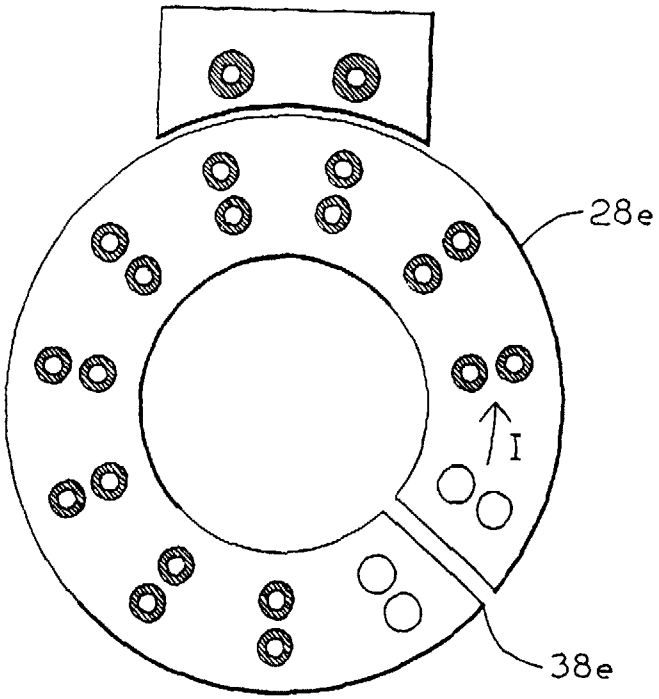
Figure 9:
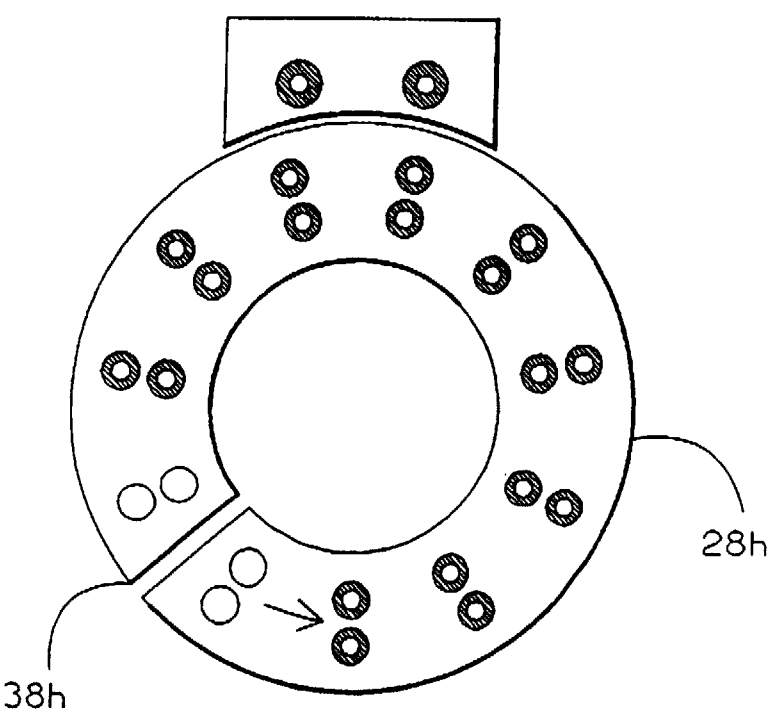
Figure 8:
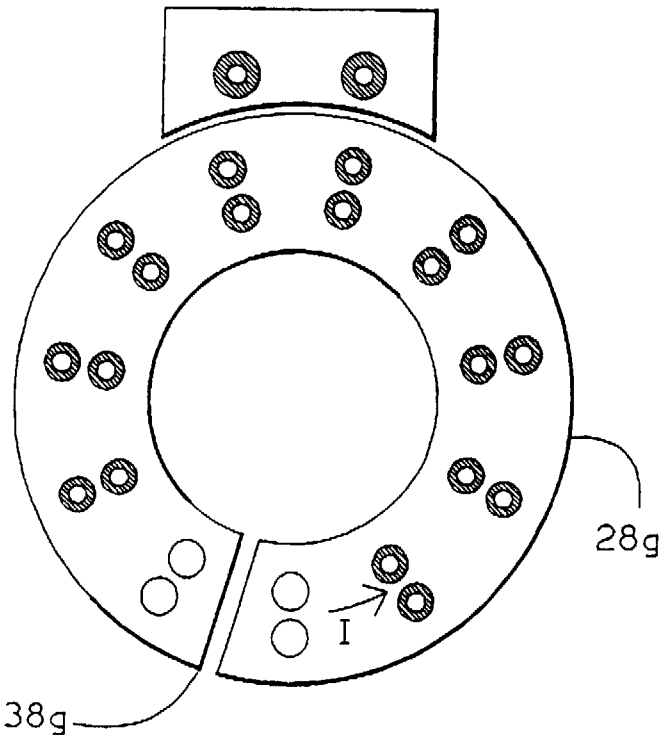
Figure 11:
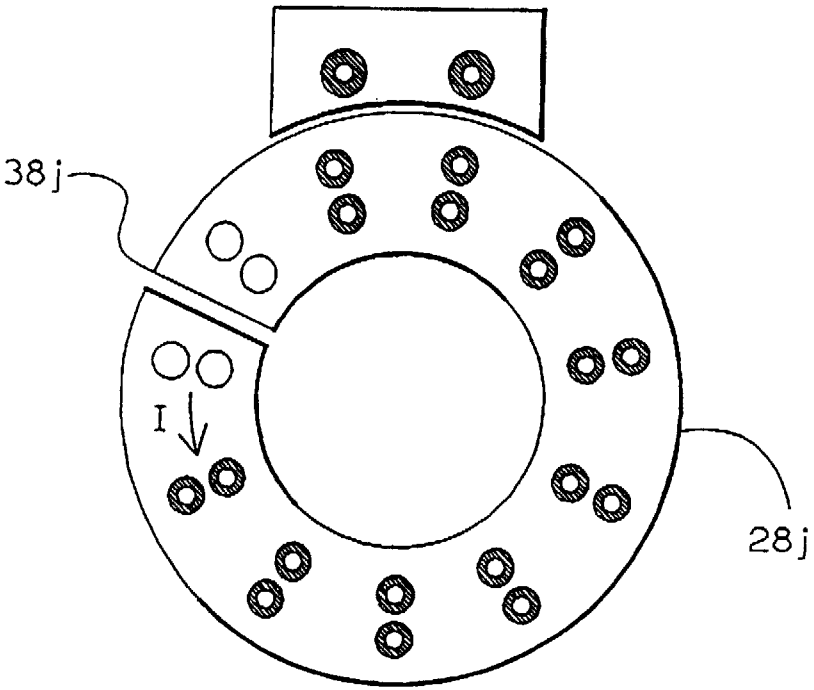
Figure 10:
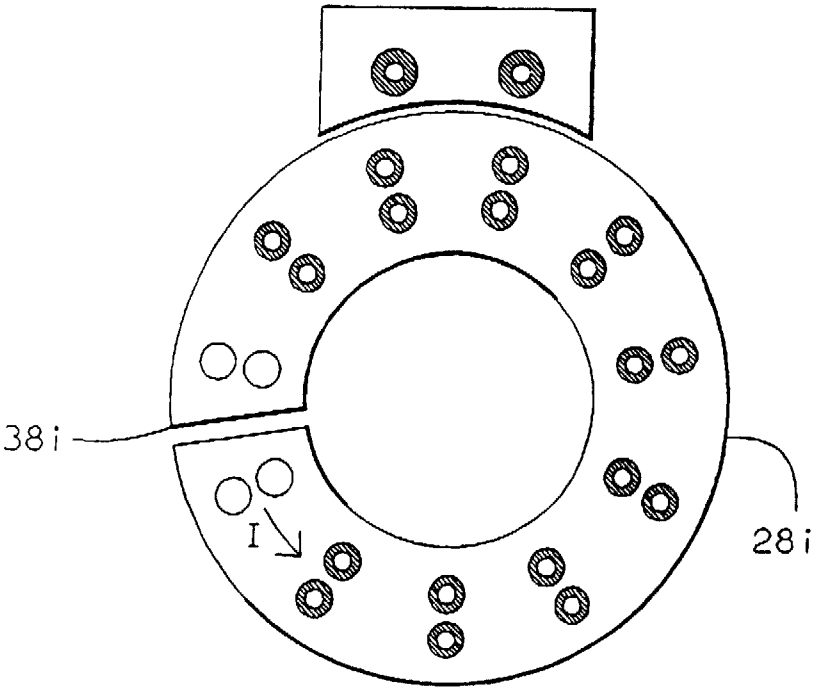
Figure 13:
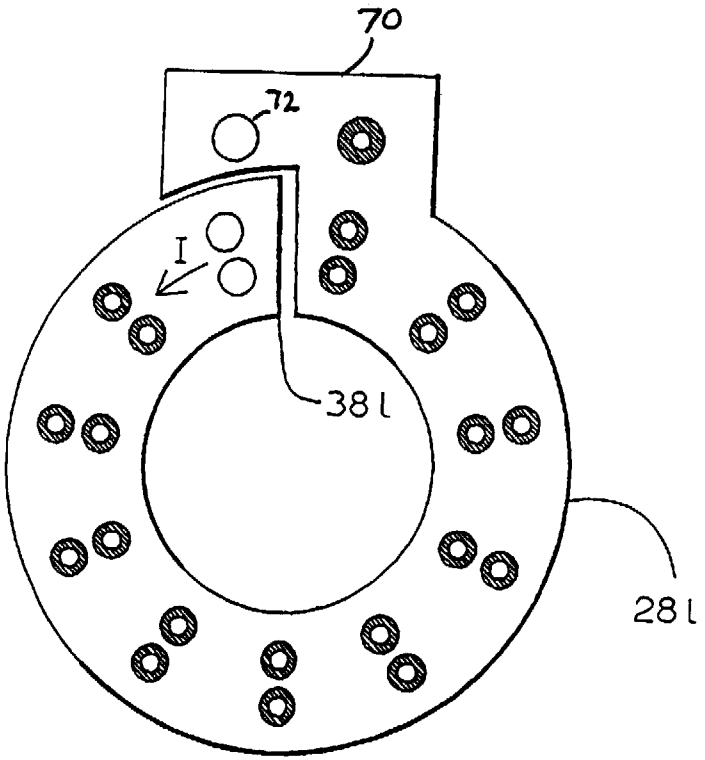
Figure 12:
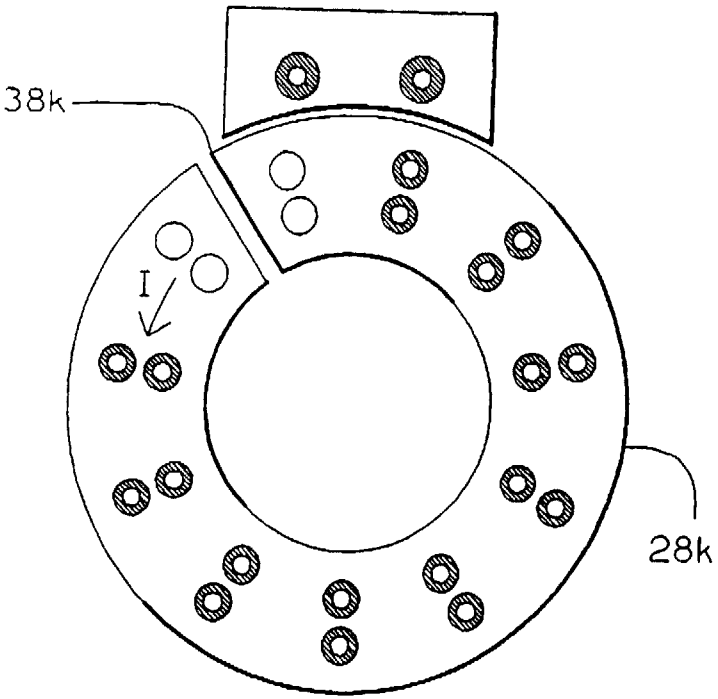

FIG. 2 also illustrates a tab conductor portion 60 integrally formed with washer-shaped conductor 28*a* to bring in current to washer-shaped conductor 28*a* of the inductor 20. Tab portion 60 also includes a through hole with a pin 62 soldered therein to connect to another one of the layers to supply the input current. However, if desired the input current can be supplied in the same layer as conductor 28*a* in which case pin 62 would not be required. FIG. 13 also illustrates a tab conductor portion 70 integrally formed with washer-shaped conductor 28N to bring current out from washer-shaped conductor 28N of the inductor 20. Tab portion 70 also includes a through hole with a pin 72 soldered therein to connect to another one of the layers to receive the output current. However, if desired the output current can be received in the same layer as conductor 28N in which case pin 72 would not be required.

After each layer is printed with the respective conductor 28*a, b* . . . N, and the conductors are etched back from the N−3 drill sites for which connection is not desired, the layers are bonded together under heat and pressure using "prepreg" glass epoxy to form multilayer printed circuit board 20. The pressure bonding also seals the layers together so that the solder used to form the vias cannot "seep" between the layers. Next, the holes are drilled through the two sets of N−1 drill sites 34*a, b* . . . N and 35*a, b* . . . N and the drill sites in the tabs 60 and 70. Then, the drill sites 34*a, b* . . . N and 35*a, b* . . . N are seeded with an adhesive such as platium chloride (water soluble) and then, electrolessly plated with copper on the adhesive. Then additional copper is electrically plated over the electroless copper plate to the desired thickness (for example, one mil). Finally, the hole is filled with solder to protect the copper plate. Thus, the turns are all connected together electrically, in series with each other. Because each washer-shaped conductor has a radial gap and there is an arcuate spacing between the drill sites and gaps, each washer shaped conductor 28*a, b* . . . N does not provide a complete turn. Rather each washer-shaped conductor 28*a, b* . . . N provides (N−1)/N turns. Therefore, the N washer-shaped conductors provide N−1 complete turns. Next, the pins 62 and 72 are soldered into the respective drill holes. Also, a large hole is drilled through the multilayer printed circuit board 20 within the conductors 28*a, b* . . . N to receive the ferrite core 24 which is secured therein.

It should be noted that the position of the drill sites and radial gaps results in nearly one full turn on each layer and N−1 complete turns from N layers, a high level of symmetry amongst the conductors 28*a, b* . . . N and a simple, predefined arrangement of drill sites and radial breaks. Also, the dimensions of each conductor and copper content are constant and readily determined. This makes the current carrying capability, series resistance, actual inductance and parasitic effects predictable. Moreover, with less than one turn per layer, each conductor can be wide to accommodate maximum current.

Based on the foregoing, an inductor according to the present invention has been disclosed. However, numerous modifications and substitutions can be made without deviating from the scope of the present invention. For example, a fewer or greater number of layers can be used to yield an inductor with fewer or greater number, respectively, of turns.

Figure 17:
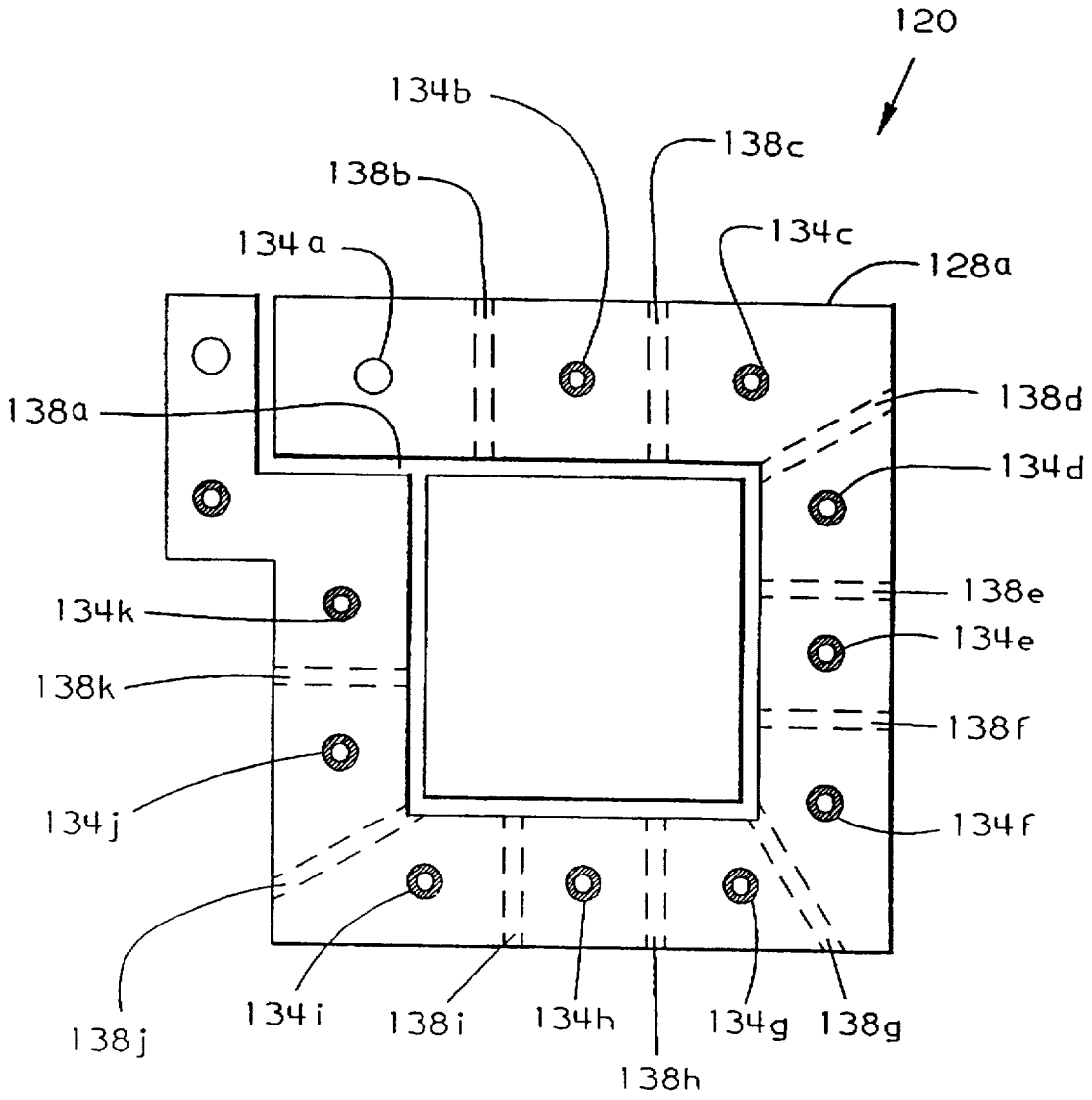
FIG. 17 is a top view of one layer of the printed circuit board of FIG. 1.

Also, as illustrated in FIGS. 17 and 18, an alternate embodiment of the inductor comprises conductors 128*a–l* printed on dielectric layers 130*a–l*, respectively. Each of the conductors is rectangular (instead of circular}, a rectangular hole is stamped within the conductors, and core material having a rectangular cross-section is supported within the hold. In the rectangular design (as in the circular design of inductor 20), vias 134*a–k* for sequential layers 128*a–l* are approximately evenly spaced around each conductor and successive vias interconnect successive conductors. Gaps 138*a–k* of successive layers proceed successively around the rectangular conductor such that electricity flows in one direction around the core and N layers yield N−1 complete turns.

It is also possible to form a transformer using similar technology as inductors 20 and 120. In the former case, conductors 28*a, b* . . . N and associated dielectric layers 30*a, b* . . . N are used for one winding of the transformer with another similar set of conductors and dielectric layers (integrally bonded to conductors 28*a, b* . . . N and dielectric sheets 30*a, b* . . . N as one printed circuit board) used to form the other winding. A single "E" and bar-shaped core as described above is used for both windings. The middle leg passes through the conductors of both the primary and secondary, and the outer legs pass through "dummy" holes. Thus, the core is mounted in a plane perpendicular to the printed circuit board.

It is also possible to use a donut-shaped core for either the inductor or transformer. In the case of the donut shaped core, one arcuate sector of the donut passes through the center of the washer-shaped conductors and the opposite arcuate sector passes either outside of the printed circuit board or through, another "dummy" hole in the printed circuit board outside of the conductors. In either case, the donut is mounted to the printed circuit board in a perpendicular plane thereto. It also may be desirable to cut-out the inductor 20 or 120 after being fabricated to use as a separate component in another environment. In such a case, two more such inductors can also be joined together to form a transformer.

Therefore, the invention has been disclosed by way of illustration and not limitation and reference should be made to the following claims to determine the scope of the present invention.

We claim:

1. An inductor comprising:

a multilayer printed circuit board comprising at least four layers wherein each layer comprises a fiberglass reinforced epoxy resin dielectric sheet and an elongated conductor printed on said sheet, each of the conductors having approximately a same shape as each other, being closed on itself except for a gap between two ends of said each conductor and being superimposed on the other conductors, the gap in each conductor being angularly offset from the gaps of the other conductors, a multiplicity of plated through-hole vias being successively positioned around said conductors, each of said vias passing through the conductors on all said four sheets and interconnecting a different combination of only two of said conductors such that current passes in a same clockwise or counterclockwise direction through all of said conductors.

2. An inductor as set forth in claim 1 wherein said vias are substantially evenly spaced around said conductors.

3. An inductor as set forth in claim 1 wherein each of said vias in succession is connected to (a) one of said conductors which is also connected to a previous via in the sequence and (b) another conductor of a next layer following a layer containing said one conductor.

4. An inductor as set forth in claim 1 wherein each of said conductors is washer-shaped.

5. An inductor as set forth in claim 4 wherein the gap in each of said washer-shaped conductors is radial, the gaps in respective conductors of successive layers being successively positioned around said inductor.

6. An inductor as set forth in claim 5 wherein one of said gaps of an associated conductor is adjacent to a via connecting said associated conductor to a conductor of a preceding layer and adjacent to another via connecting said associated conductor to a conductor of a succeeding layer.

7. An inductor as set forth in claim 6 wherein said vias are substantially evenly spaced around said conductors and each of said vias in succession is connected to (a) one of said conductors which is also connected to a previous via in the sequence and (b) another conductor of a next layer following a layer containing said one conductor.

8. An inductor as set forth in claim 1 wherein the gaps of associated conductors of successive layers are successively positioned around said inductor.

9. An inductor as set forth in claim 8 wherein one of said gaps of an associated conductor is adjacent to a via connecting said associated conductor to a conductor of a preceding layer and adjacent to another via connecting said associated conductor to a conductor of a succeeding layer.

10. An inductor as set forth in claim 9 wherein said vias are substantially evenly spaced around said conductors and successive vias connect conductors of successive layers.

11. An inductor as set forth in claim 1 further comprising a first tab portion integral with and formed on an outer one of said layers to bring current into said inductor and a second tab portion integral with and formed on another outer one of said layers to bring current out from said inductor.

12. An inductor as set forth in claim 1 further comprising a second multiplicity of vias successively positioned around said conductors and radially aligned with respective vias of the first said multiplicity, said second multiplicity of vias passing through the multiplicity of layers, each of said second multiplicity of vias interconnecting same conductors as the respective vias from said first multiplicity.

13. An inductor as set forth in claim 1 further comprising core material located within the printed circuit board in a center of said conductors.

14. An inductor as set forth in claim 1 wherein said conductors have rectangular inner and outer edges.

15. An inductor as set forth in claim 1 wherein there are at least four vias passing through all of said conductors.

16. An inductor as set forth in claim 1 wherein said vias are spaced from one another such that each conductor forms (N−1)/N turn wherein N equals the total number of conductors, and the N conductors form N−1 complete turns.

17. A transformer comprising:

a multilayer printed circuit board comprising at least four layers wherein each layer comprises a fiberglass reinforced epoxy resin dielectric sheet and an elongated conductor printed on said sheet, each of said conductors having approximately a same shape as each other, being closed on itself except for a gap between two ends of said each conductor, and being superimposed on the other conductors, the gap in each conductor being angularly offset from the gaps of the other conductors, a multiplicity of plated through-hole vias being successively positioned around said conductors, each of said vias passing through the conductors on all said four sheets and interconnecting a different combination of two of said conductors such that current passes in a same clockwise or counterclockwise direction through all of said conductors.

18. A transformer as set forth in claim 17 wherein said vias are approximately evenly spaced around said conductors.

19. A transformer as set forth in claim 17 wherein each of said vias in succession is connected to (a) one of said conductors which is also connected to a previous via in the sequence and (b) another conductor of a next layer following a layer containing said one conductor.

20. A transformer as set forth in claim 17 wherein each of said conductors is washer-shaped.

21. A transformer as set forth in claim 20 wherein each of said gaps is radial, and the gaps of conductors of successive layers are successively positioned around said conductors.

22. A transformer as set forth in claim 21 wherein one of said gaps of an associated conductor is adjacent to a via connecting said associated conductor to a conductor of a preceding layer and adjacent to another via connecting said associated conductor to a conductor of a succeeding layer.

23. A transformer as set forth in claim 22 wherein said vias are approximately evenly spaced around said conductors and each of said vias in succession is connected to (a) one of said conductors which is also connected to a previous via in the sequence and (b) another conductor of a next layer following a layer containing said one conductor.

24. A transformer as set forth in claim 17 wherein the gaps of successive conductor layers are successively positioned around said inductor.

25. A transformer as set forth in claim 24 wherein one of the gaps within an associated conductor is adjacent to a via connecting said associated conductor to a conductor of a preceding layer and adjacent to another via connecting said associated conductor to a conductor of a succeeding layer.

26. A transformer as set forth in claim 25 wherein said vias are approximately evenly spaced around said conductors and each of said vias in succession is connected to (a)

one of said conductors which is also connected to a previous via in the sequence and (b) another conductor of a next layer following a layer containing said one conductor.

27. A transformer as set forth in claim 17 further comprising core material located within the printed circuit board in a center of said conductors.

28. A transformer as set forth in claim 17 wherein there are at least four vias passing through all of said conductors.

29. A transformer as set forth in claim 17 wherein said vias are spaced from one another such that each conductor forms (N−1)/N turn wherein N equals the total number of conductors, and the N conductors form N−1 complete turns.

30. An inductor comprising:

a multilayer printed circuit board comprising at least three layers wherein each layer comprises a dielectric sheet and a conductor printed on said sheet, each of the conductors having approximately a same shape as each other, being substantially but not completely closed on itself and being superimposed on the other conductors, a multiplicity of through-hole vias being successively positioned around said conductors and passing through said at least three layers, each of said vias interconnecting a different combination of two of said conductors such that current passes in a same clockwise or counterclockwise direction through all of said conductors; and wherein said vias are spaced from one another such that each conductor forms (N−1)/N turn wherein N equals the total number of conductors, and the N conductors form N−1 complete turns.

31. A transformer comprising:

a multilayer printed circuit board comprising at least three layers wherein each layer comprises a dielectric sheet and a conductor printed on said sheet, each of said conductors having approximately a same shape as each other, being substantially but not completely closed on itself and being superimposed on the other conductors, a multiplicity of through-hole vias being successively positioned around said conductors and passing through said layers, each of said vias interconnecting a different combination of two of said conductors such that current passes in a same clockwise or counterclockwise direction through all of said conductors; and wherein said vias are spaced from one another such that each conductor forms (N−1)/N turn wherein N equals the total number of conductors, and the N conductors form N−1 complete turns.

* * * * *